United States Patent [19]

Leon et al.

[11] Patent Number: 4,664,922

[45] Date of Patent: May 12, 1987

[54] PACKAGE FOR PRESERVING FOOD BY GENERATING A MODIFIED GAS ATMOSPHERE

[76] Inventors: Jean G. Leon, 5, rue du Maréchal de Lattre de Tassigny, 92200 Neuilly Sur Seine; François Loevenbruck, 45, rue Lévis, 75017 Paris; Jean R. Troadec, 101, rue Hoche, 92220 Colombes, all of France

[21] Appl. No.: 711,522

[22] Filed: Mar. 14, 1985

[51] Int. Cl.[4] ..... B65D 81/20

[52] U.S. Cl. ..... 426/124; 426/129; 426/316; 426/418

[58] Field of Search ..... 426/124, 129, 130, 112, 426/394, 316, 418, 398

[56] References Cited

U.S. PATENT DOCUMENTS

| | | | |
|---|---|---|---|
| 2,357,258 | 8/1944 | Harris | 426/124 |
| 2,497,399 | 2/1950 | Dexter | 426/124 |
| 2,719,660 | 10/1955 | Ellis | 426/124 |
| 3,026,209 | 3/1962 | Niblack et al. | 426/129 |
| 3,111,412 | 11/1963 | Mouk | 426/124 |
| 3,155,303 | 11/1964 | Fenkel | 426/129 |
| 3,209,978 | 10/1965 | Dupuis | 426/124 |
| 3,346,398 | 10/1967 | Tundermann et al. | 426/124 |
| 3,409,444 | 11/1968 | Gentry et al. | 426/316 |
| 3,415,662 | 12/1968 | Koger et al. | 426/124 |
| 3,559,562 | 2/1971 | Carlson et al. | 426/124 |
| 3,575,287 | 4/1971 | Graveley | 426/124 |
| 3,603,454 | 9/1971 | Raaf | 426/124 |
| 3,798,340 | 3/1974 | Reinbold et al. | 426/130 |
| 3,834,606 | 9/1974 | Andersson | 426/129 |
| 3,939,971 | 2/1976 | Tulis | 426/124 |
| 4,041,209 | 8/1977 | Scholle | 426/124 |
| 4,058,630 | 11/1977 | Busnel | 426/394 |
| 4,061,985 | 12/1977 | Nishino et al. | 426/124 |
| 4,186,215 | 1/1980 | Buchel | 426/86 |
| 4,382,507 | 5/1983 | Miller | 426/124 |
| 4,411,918 | 10/1983 | Cimino et al. | 426/124 |
| 4,540,616 | 9/1985 | Gilmore et al. | 426/129 |

FOREIGN PATENT DOCUMENTS

| | | | |
|---|---|---|---|
| 2428843 | 1/1975 | Fed. Rep. of Germany | 426/130 |
| 2313870 | 11/1977 | France | 426/124 |
| 56-164006 | 12/1981 | Japan | 426/124 |
| 56-164007 | 12/1981 | Japan | 426/124 |
| 1131848 | 10/1968 | United Kingdom | 426/124 |
| 2003836 | 3/1979 | United Kingdom | 426/129 |

OTHER PUBLICATIONS

J. of Agricultural Food Chem., p. 1208 Plus vol. 23#6, 1975.

*Primary Examiner*—Steven Weinstein
*Attorney, Agent, or Firm*—Browdy and Neimark

[57] ABSTRACT

An improved packing more particularly for foodstuffs of the type composed of a receptacle sealingly closed by a removable lid and comprising therein a perforated separation wall in form of a grid disposed substantially in parallel to the bottom of said receptacle thereby to provide a two-section separation of the latter such that the upper compartment is reserved for lodging the foodstuff to be preserved, with the lower compartment being adapted to receive an absorbent material intended for absorbing the exsudate from said foodstuff, wherein there is provided on, or in, said absorbent material such material capable, under the effect of water from the exsudate, of releasing an inert gas in such quantity as to compensate for the loss of pressure within the receptacle on the one hand, and on the other hand, capable of creating such an atmosphere as to prevent formation of secondary noxious products, and compensating for the loss of some of the constitutive components of the foodstuff carried away with the exsudate.

5 Claims, 4 Drawing Figures

PACKAGE FOR PRESERVING FOOD BY GENERATING A MODIFIED GAS ATMOSPHERE

FIELD OF THE INVENTION

This invention relates to an improved packing, more particularly, for foodstuffs, such packing being composed of a receptacle sealingly closed by a removable lid.

More especially, the type of receptacle in question intended for substantially prolonging the preservation period of foodstuffs, i.e. for postponing the limiting date of sale comprises therein a perforated separation wall in form of "grid" disposed substantially in parallel to the bottom of the receptacle thereby providing for two-section separation thereof, so that the upper compartment is kept for lodging the foodstuffs to be preserved, with the lower compartment being possibly divided into several volumes and being intended to receive a material preferably in form of a sheet the purpose of which is to absorb the exudate from said foodstuff.

BACKGROUND OF THE INVENTION

This type of receptacle is well known and their design or realization is mainly due to the fact that the foodstuffs of animal origin such as fish, meat, shells and crustacea let an exudate flow therefrom, such exudate upon untimely contact therewith or during preservation of its foodstuffs being susceptible to carrying germs or other micro-organisms harmful to human beings.

For example, botulism is a serious poisoning produced by the toxin of a bacilla anaerobic i.e. drawing out the elements necessary for life from organic substances decomposed thereby.

Thus, commercialization of foodstuffs is only possible for a certain period, the end, of which called "limiting date of sale", should be postponed without alteration of the foodstuffs to satisfy requirements for wholesome alimentation but also for economical distribution thereof. This limiting date of sale is mentioned on the receptacle.

It is also known to commercialize fresh foodstuffs in a sealingly closed receptacle of this type in which an inert gas or a mixture of gases such as carbonic anhydride and oxygen are injected to favour preservation thereof by slowing down organic degradation, such receptacles being generally kept at a low temperature. The function of the absorbent material housed in the lower compartment is to absorb the exudate to prevent the foodstuffs from getting into contact with the latter. Thus, the foodstuffs are kept fresh, any risk of contamination by such exudate being eliminated, thereby substantially postponing the limiting date of sale.

Although this type of receptacle may be satisfactory it does not prevent any development of cultures producive of secondary noxious products on the absorbent material when it is moistened by the exudate after drying and positioning into the receptacle.

Moreover, the various gaseous atmospheres presently realized are absorbed in the course of time by the foodstuffs, thereby resulting in decrease of the inner pressure prevailing in said receptacle, and consequently deformation thereof.

SUMMARY OF THE INVENTION

The object of this invention is therefore to prevent formation of the above-mentioned secondary noxious products, on the one hand, and on the other hand, to maintain in the course of time the relatively constant pressure of gases within the sealingly closed packing. To this end, there is provided according to the invention for the presence on or in the absorbent material of such a material which is capable under the effect of the water from the exudate to release an inert gas in such a quantity as to compensate for the pressure loss within the receptacle, on the one hand, and on the other hand, create such an atmosphere as to prevent formation of any secondary noxious products.

Advantageously, the material in question is based on a substance releasing $CO_2$ and/or oxygen and the function of which is to maintain the desired pressure within the receptacle, on the one hand, and on the other hand, on a substance capable of being carried away with said gas to create the also desired atmosphere preventing development of any noxious products or compensating for the loss of salts or oligo-elements carried away from the foodstuffs by the exudate.

Advantageously, the material in question contains a carbonate and/or a persalt in combination with a non toxic organic acid.

By way of example, there can be cited as carbonate, sodium carbonate or bicarbonate of the alimentary quality, as persalt, the sodium percarbonate or perborate, and as organic acid, citric acid.

Moreover, said material contains one of the components of the foodstuff carried away by the exudate as the substance capable of creating the desired atmosphere and of being carried away by the gas released by said material. By way of example, there can be cited sodium chloride or one of the oligo-elements contained in said foodstuff.

Other advantages and characteristics of this invention will appear more clearly from the following description which is made in reference to the attached drawings, which illustrate merely by way of explanation a receptacle to which the improvement according to this invention can be applied.

DETAILED DESCRIPTION OF THE PREFERRED EMBODIMENTS

Figure 1:
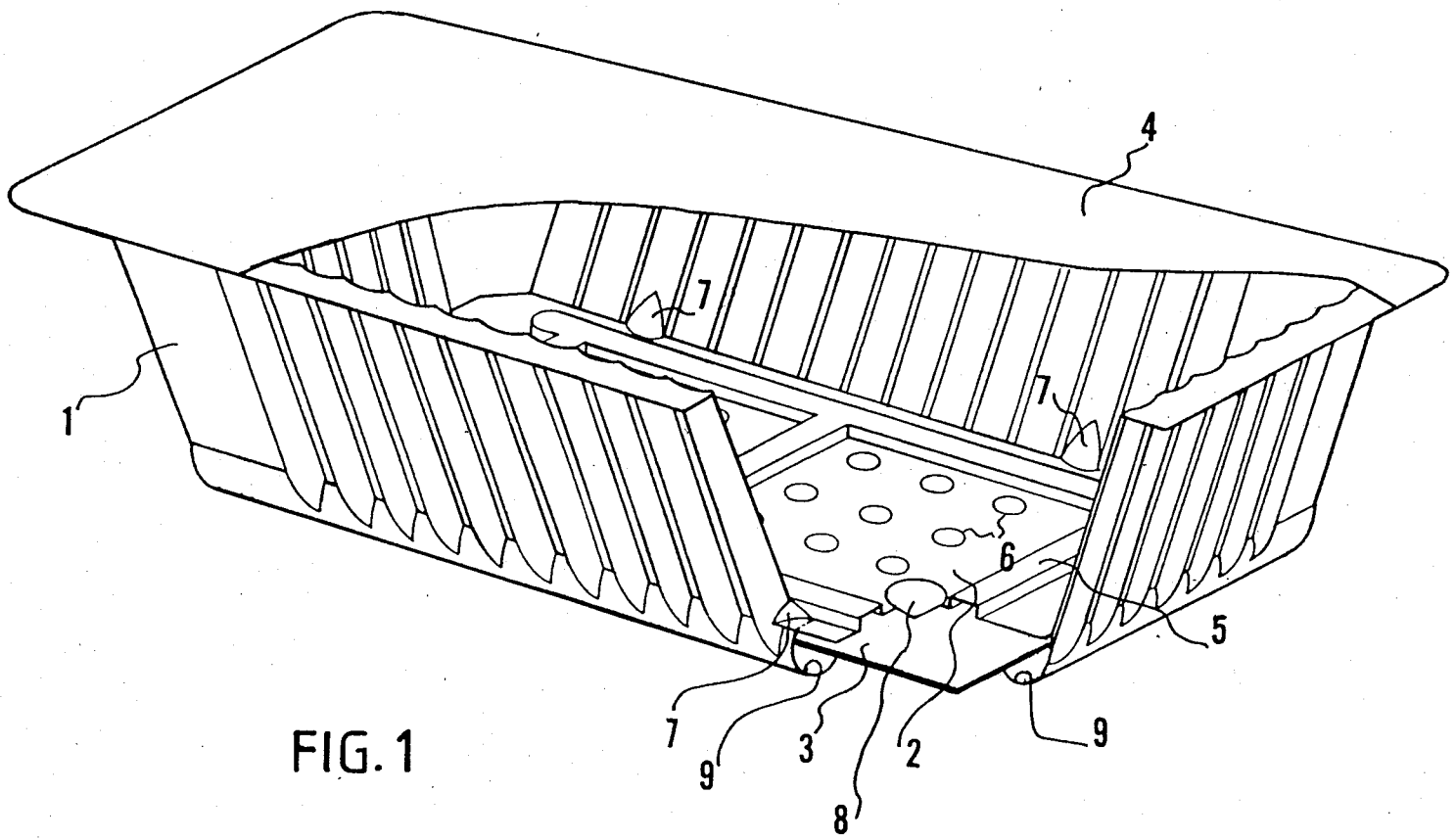
FIG. 1 presents an example of package in an isometric projection view with partial removal of parts.

With reference to FIG. 1, there can be seen a package composed of a receptacle 1, a separation grid 2, a sheet of material 3, to absorb exudate from the foodstuff disposed on the separation grid (not shown), closed sealingly by a lid 4. The separation grid 2 is a plate formed with ribs 5 and holes 6 therein. It is inserted into the receptacle 1 by means of four lugs 7 projecting inwardly of the receptacle and disposed by pairs on its lateral walls opposite to one another. In view of this, the separation grid 2 which is formed with four projecting elements 8 in form of studs cannot escape from the bottom of the receptacle 1 even in the event that the latter should tip over. Furthermore, the studs 8 maintain the sheet of material 3 to absorb exudate from the foodstuff applied against the bottom of the receptacle 1. The sheet of absorbent material 3 penetrates into a peripheral groove 9 for draining off exudate, formed about a stepped portion in the bottom of the receptacle. It has a substantially rectangular shape with clipped off corners to fit with minimum clearance into the lower compartment of the receptacle.

Figure 2:
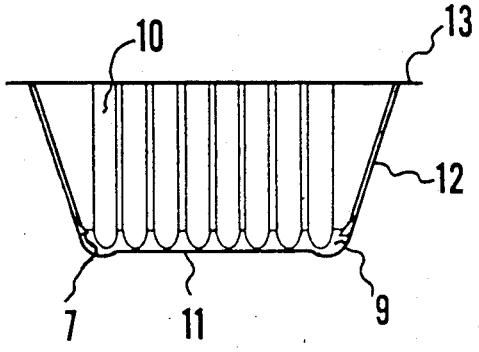
FIG. 2 is a sectional view at the level of the receptacle lugs of the package shown in FIG. 1.

FIG. 2 which shows a receptacle 1 in cross-section illustrates strengtheners 10 and lugs 7. The strengtheners 10 are obtained by adapted conformation of the lateral walls of the receptacle. The bottom of the receptacle 1 comprises a stepped section 11 connectible to the lateral walls 12 of the receptacle 1 by a peripheral groove 9. A lid 4 can be welded to the upper edge portions 13 parallel to the bottom of the receptacle.

Figure 3:
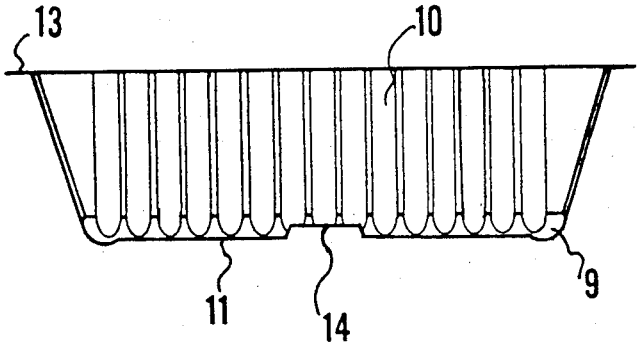
FIG. 3 is a sectional view of another possible mode of embodiment of the package.

In FIG. 3 there can be seen strengthening means 10 for a receptacle 1 without such lateral studs as previously shown in reference to FIGS. 1 and 2. The bottom of the receptacle has a double stepped section i.e. the stepped section 11 with which the sheet of absorbent material 3 perforated in its center to permit a central shoulder 14 of the bottom of the receptacle 1 to pass therethrough, comes into contact on the inner face of the receptacle 1. On the upper face of such shoulder there is glued a separation grid 2 which as explained above comprises studs 8 to keep the sheet of absorbent material 3 applied to the bottom of the receptacle 1.

Figure 4:
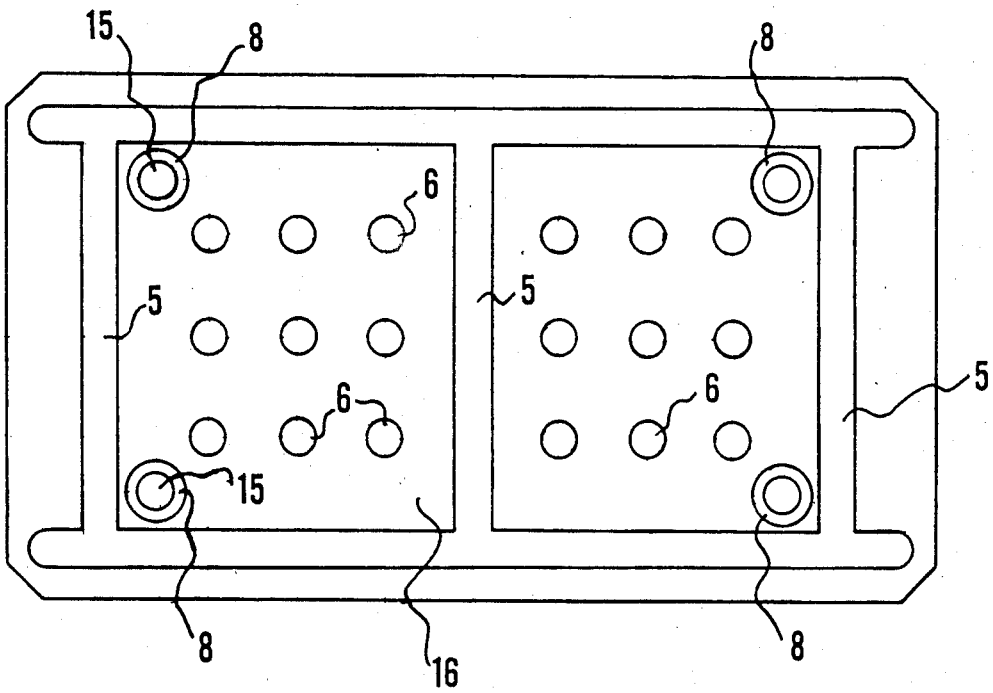
FIG. 4 is a top view of a separation grid present in the packing.

In FIG. 4 there is shown in a top view a separation grid 2 with its ribs 5 and four studs 8 projecting from the other side of the separation grid 2. The ribs 5 present a central planar surface 15 substantially parallel to the plane defined by the body 16 of the separation grid 2 formed with holes 6 therein to enable the exudate to flow out toward the sheet of material absorbing it.

These central planar surfaces 15 can be glued to the sheet of absorbent material 3 itself partly glued to the bottom of the receptacle 1.

It will be understood that when such glueing method is not used the studs 8 can have any adapted shape for example a conical or hemispheric shape.

It will be noted that in all the described forms of embodiment two characteristics are essential if the receptacle 1 should become inclined, i.e. there is constant absorption of exudate by the sheet of absorbent material 3 which comes into contact with the edges 12 of the receptacle 1, and the sheet of absorbent material 3 cannot come into contact with the foodstuff contained in the receptacle due to the studs 8 of the separation grid 2 which prevent any contact of the foodstuff with the sheet of absorbent material 3, even though the holes 6 in the separation grid 2.

In accordance with this invention, the sheet of absorbent material 3 comprises therein or on its surface, such plates, blocks, fragments, chips, inserts, or a powder substantially constituted by a compound capable of releasing an inert gas such as $CO_2$ and/or oxygen under the action of water from the exudate, advantageously in the presence of a non toxic organic acid or a substance capable of being carried away by said gas to create an atmosphere or a fog within the receptacle of the type described above.

Thus, for example in the particular case of the foodstuff being fish, such fog or such atmosphere will be preferably constituted by sodium chloride to compensate for the loss thereof during exudation of the fish. It results that the absorbent material will contain sodium chloride which will be carried away for example by carbonic anhydride formed due to the presence on, or in, the absorbent sheet of sodium carbonate or bicarbonate of alimentary quality and citric acid. Similarly, there will also be possible to provide for release of oxygen for example due to the presence of a percarbonate and/or perborate.

There can be cited as an example of formula within the scope of the invention a composition containing (by weight) 50% of sodium chloride, 25% of citric acid, 25% of sodium carbonate or 33.5% of sodium chloride, 33.5% of citric acid, 16.5% of percarbonate and 16.5% of perborate.

These formulae can possibly be completed by replacing part of the sodium chloride with a salt or an oligo-element entering into the composition of the foodstuff to be preserved, and which may be carried away by its exudate.

By proceeding in this way in accordance with the invention, the gaseous release obtained compensates for the loss of pressure that may occur within the receptacle thereby preventing deformation thereof and the salt or the oligo-element carried away by said gaseous release compensates for loss of mineral salts or the oligo-element carried away in the exsudate, on the one hand, and on the other hand, prevents harmful production of secondary noxious products.

It will be understood that this invention was only described in a purely explanatory and not at all limitative manner, and that any useful modification can be entered therein without departing from its scope.

We claim:

1. A foodstuffs package comprising a receptacle sealingly closed by a removable lid, and including therein a perforated separation wall in the form of a grid disposed substantially parallel to the bottom of said receptacle, thereby providing two sections in the bottom of the receptacle, such that a foodstuff to be preserved is housed in the upper compartment, with the lower compartment containing an absorbent material for absorbing water containing exudate from said foodstuff;

the improvement comprising providing with said absorbent material a composition which comprises both an agent which releases carbon dioxide gas upon contact with water from the exudate and sodium chloride, said agent being in an amount sufficient to create a carbon dioxide atmosphere within the sealed package to prevent formation of secondary noxious products and said sodium chloride being in an amount and relationship to the agent sufficient to be carried away by said gas and compensate for the loss thereof from the foodstuff during exudation.

2. A package according to claim 1 wherein said composition contains a compound selected from the group consisting of carbonates and bicarbonates in combination with a non toxic organic acid.

3. An improved packing according to claim 2, wherein said carbonates and said bicarbonates are selected from the group consisting of sodium carbonate and bicarbonate, and said organic acid is citric acid.

4. An improved packing according to claim 1 wherein said material is in the form of plates, blocks, fragments, chips, inserts, or in a pulverulent form.

5. An improved packing according to claim 1, wherein said composition contains by weight 50% of sodium chloride, 25% of citric acid and 25% of sodium carbonate.

* * * * *